United States Patent [19]

Goodwin et al.

[11] Patent Number: 4,529,190

[45] Date of Patent: Jul. 16, 1985

[54] SHEET UNLOADING DEVICE

[75] Inventors: Eber L. Goodwin, Arlington Heights; James E. L. Zeigler, Cary, both of Ill.

[73] Assignee: AM International, Inc., Chicago, Ill.

[21] Appl. No.: 498,342

[22] Filed: May 26, 1983

[51] Int. Cl.[3] ..... B65H 31/32

[52] U.S. Cl. ..... 271/213; 271/189; 271/218; 271/224

[58] Field of Search ..... 271/213, 189, 217, 4, 271/9, 162, 163, 164, 200, 201, 204, 212, 218, 214, 245; 414/50; 217/223, 207, 212-214, 217-218, 245, 4, 9, 162-164, 189, 200-201, 204, 245

[56] References Cited

U.S. PATENT DOCUMENTS

| | | | |
|---|---|---|---|
| 2,005,370 | 6/1935 | Hughey | 271/213 |
| 3,539,055 | 11/1970 | Jiruse et al. | 271/189 X |
| 4,002,249 | 1/1977 | Shinomiya et al. | 271/217 X |

FOREIGN PATENT DOCUMENTS

| | | | |
|---|---|---|---|
| 503811 | 6/1951 | Belgium | 271/189 |

*Primary Examiner*—Bruce H. Stoner, Jr.
*Assistant Examiner*—Lawrence J. Goffney, Jr.
*Attorney, Agent, or Firm*—Nicholas A. Camasto; John R. Hoffman

[57] ABSTRACT

A sheet unloading device for use in a printing or duplicating machine, or the like, wherein sheets are delivered seriatim to a receiving tray whereat the sheets are deposited onto the top of a stack of sheets in the tray. An interposer mechanism is movable to an operative position at the end of the tray for dividing the tray into a first, lower portion and a second, upper portion. The interposer mechanism permits removal of the lower portion of the stack while sheets are continuously delivered to the upper portion of the stack. A back stop is provided at the end of the tray and can be selectively lowered to permit removal of the lower portion of the stack of sheets.

11 Claims, 5 Drawing Figures

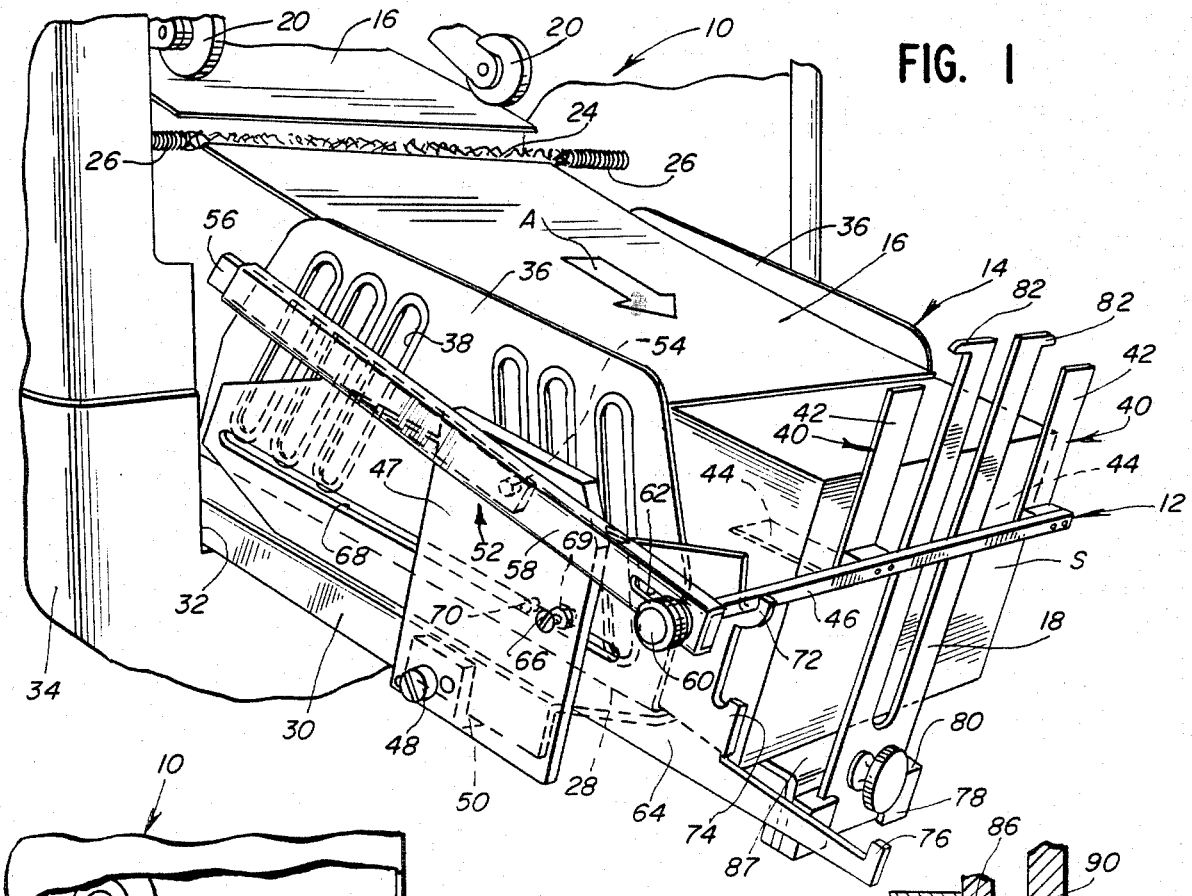
FIG. 1
FIG. 3
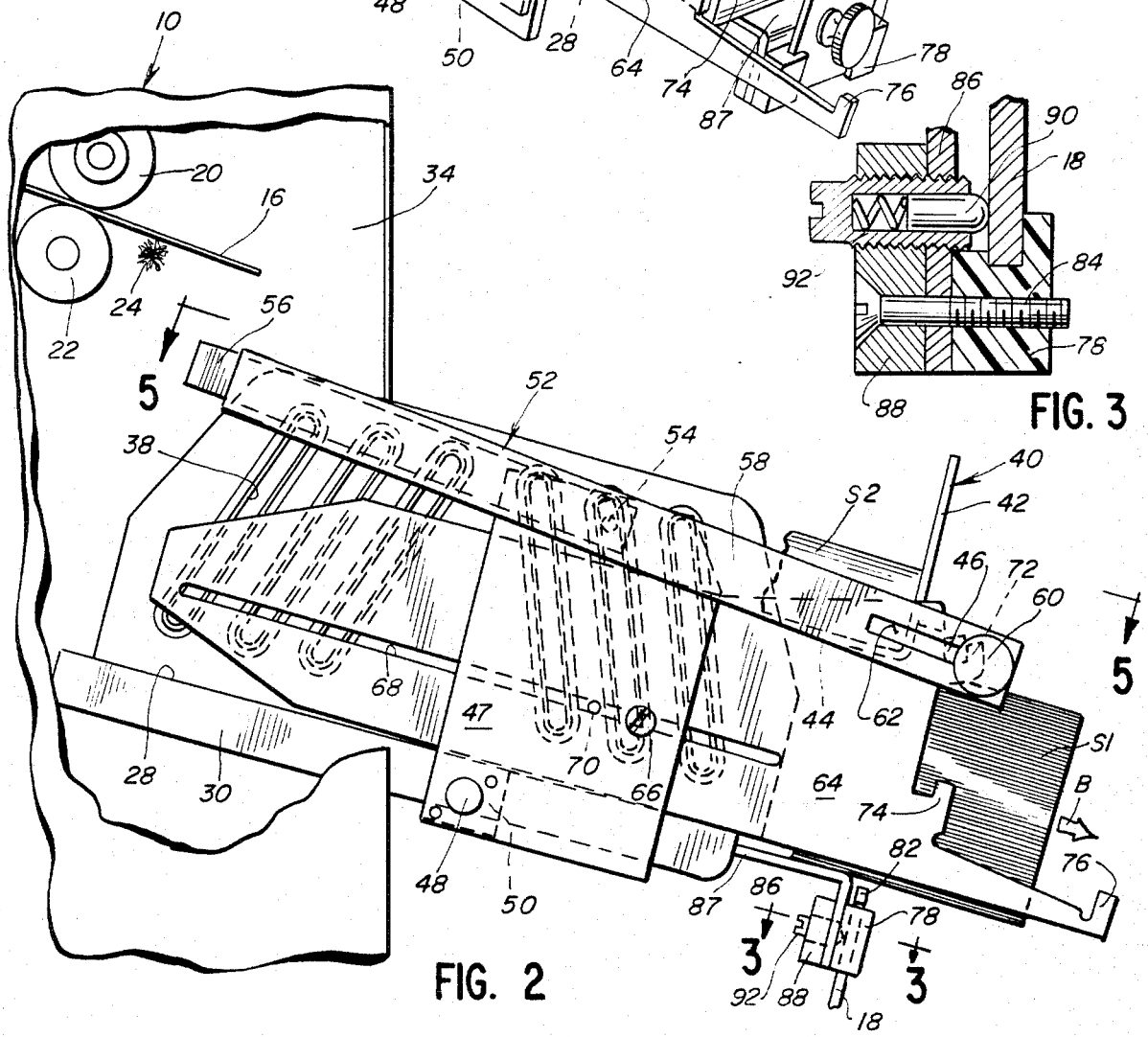
FIG. 2

SHEET UNLOADING DEVICE

BACKGROUND OF THE INVENTION

This invention relates to a sheet unloading device for use in a duplicating machine or the like wherein sheets are delivered seriatim at the exit end of the machine.

Printing or duplicating machines, such as rotary offset lithographic duplicating machines, normally are provided with some form of sheet receiving means at the exit end of the machine for stacking copy sheets issuing from the machine. Conventionally, the sheet receiving means comprises a receiving tray for receiving and stacking the sheets. The sheets normally fall by gravity and come to rest onto the top of a stack in the tray. Periodically, or when the tray is full, the stack of sheets is removed from the tray by the machine operator. This normally is done simply by grasping the stack and lifting the stack out of the tray. Aside from unloading the tray, the machine operator may wish to remove one or more copy sheets at a time while the machine is operating to inspect the quality of the duplicated copies. The removal of the stack of sheets or the selected inspection of a single copy usually can be performed by a skilled operator while the machine is operating at relatively slow speeds. However, such operations are extremely difficult, if at all possible, at higher machine speeds such as on the order of 8,000 to 15,000 impressions per hour (IPH). A target of some such machines is to reach 20,000 impressions per hour. At the higher speeds, the slightest disturbance of a single sheet normally results in sheet jamming. The present invention can be used at all speed levels and is particularly useful with machines operating at the higher speeds.

In addition, larger or longer sizes are more difficult to unload because of the smaller gap or time interval between the trailing end of one sheet and the leading of a succeeding sheet being deposited in the tray. Also, the weight of larger sheets increases the difficulty of unloading the tray. Accordingly, the usual procedure for performing such operations as unloading or sheet inspection at high machine speeds is to stop the feeding of sheets to the machine or to shut down the machine completely.

There is a need for a device which permits unloading of the receiving tray while the machine is running at high speeds without interruption of the sheet feeding operation or stopping the machine as is normally required by prior devices. Such a device would greatly increase production because continuous unloading permits an operator to complete a full feeder load without stopping to unload the receiving tray. Continuous unloading also would permit an operator to inspect the quality of the duplicated copies as well as to perform other functions, such as preparing for the next color run on the previously duplicated copies, turning the stock over for back-up printing, packaging the stock for delivery or moving the stock to a subsequent operation. All of these extraneous functions heretofore had to be performed during machine shut-down.

The invention is directed to a device for unloading sheets from the receiving tray while the machine continues to operate at high speeds and while sheets are continuously being delivered to the receiving tray.

SUMMARY OF THE INVENTION

An object, therefore, of the invention is to provide a new and improved device for facilitating unloading of sheets from a printing or duplicating machine.

Another object of the invention is to provide a sheet unloading device which provides for continuous unloading of the sheets while the machine is operating at high speeds, without interruption.

In the exemplary embodiment of the invention, a sheet unloading device is adapted for use in a printing machine or the like wherein sheets are delivered seriatim to a receiving tray whereat the sheets are deposited onto the top of a stack of sheets in the tray. Interposer means are movable to an operative position at the end of the tray for dividing the stack into a first, lower portion and a second, upper portion. The interposer means permit removal of the lower portion of the stack while sheets are continuously delivered to the upper portion of the stack. Thus, continuous unloading can be performed without either interrupting sheet delivery to the receiving tray or complete shut-down of the machine itself.

The interposer means are mounted on the receiving tray by pivot support means which defines a pivot axis extending transversely of the tray and provides for sliding movement of the interposer means generally perpendicular to the pivot axis. The pivot support means thus provide a swinging path of travel for the interposer means from an inoperative position beneath the receiving tray through an arc around the end of the tray and into the operative position at the end of the tray.

Rack means are provided for releasably supporting the interposer means in its operative position. Preferably, the rack means include a plurality of support portions for supporting the tray in any one of a plurality of operative positions to vary the size of the portion of the stack to be removed. The rack means also include another support portion for supporting the interposer means in an intermediate position spaced outwardly from the end of the tray.

Another feature of the invention is the provision of back stop means mounted at the end of the receiving tray for movement between a first position for arresting sheets deposited into the tray and a second position permitting removal of the lower portion of the stack from the tray. Preferably, the back stop means are mounted for generally vertical movement between a raised position to block the end of the tray and a lowered position below the tray. The interposer means itself include back stop means for arresting sheets deposited onto the upper portion of the stack when the first back stop means is lowered.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a fragmented perspective view of the sheet unloading device of the invention mounted on a receiving tray of a printing or duplicating machine, with the interposer means in one of its operative positions;

FIG. 2 is a side elevation of the invention in the condition of FIG. 1, with the back stop means lowered and the lower portion of the stack being removed;

FIG. 3 is a fragmented section taken generally along line 3—3 of FIG. 2;

DETAILED DESCRIPTION OF THE PREFERRED EMBODIMENT

Figure 4:
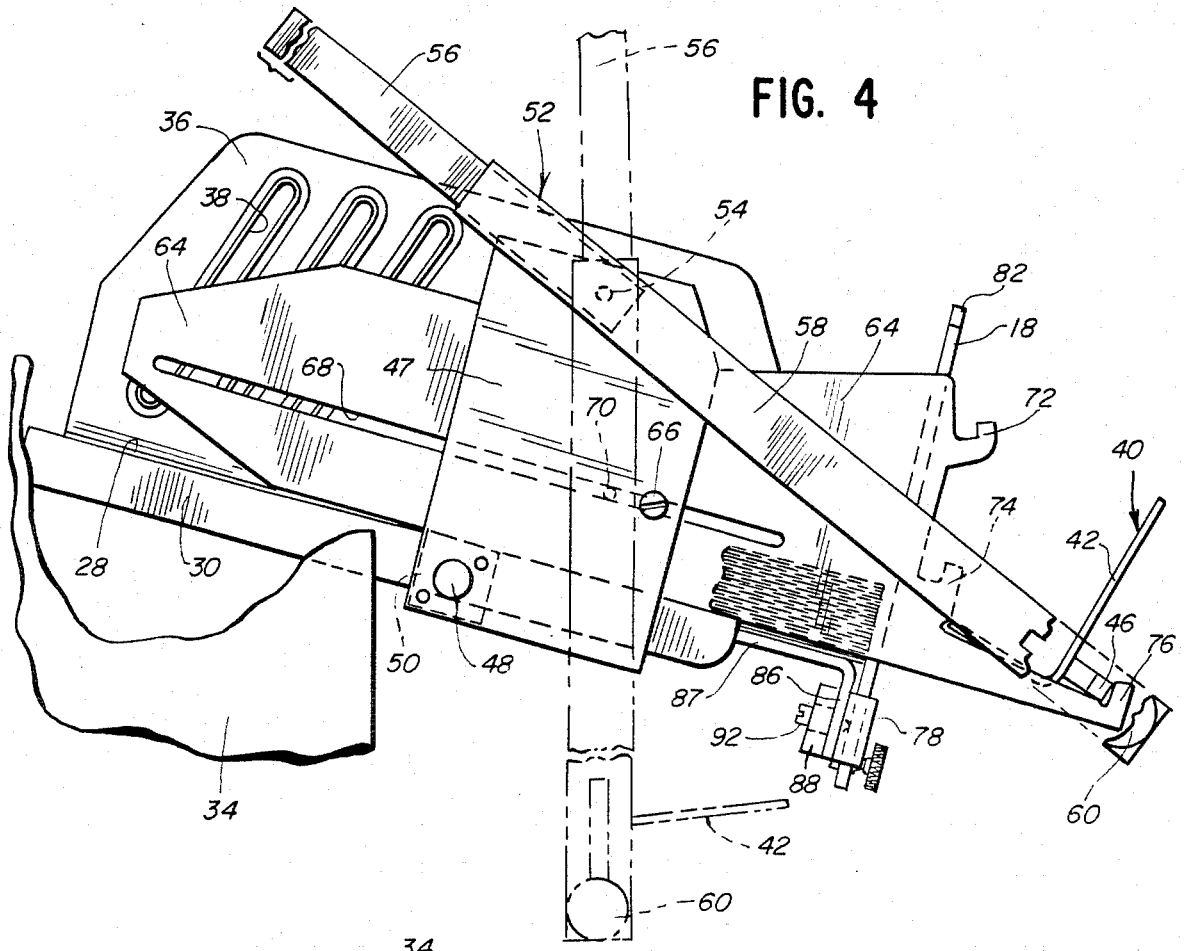
FIG. 4 is a side elevation of the invention with the interposer means shown in full lines in its intermediate position and in phantom in its inoperative position.

Referring to the drawings in greater detail, and first to FIGS. 1 and 2, the present invention is shown in conjunction with a printing or duplicating machine, a fragmented portion of which is generally designated 10. The invention comprises a sheet unloading device, generally designated 12, mounted on a receiving tray, generally designated 14, at the exit end of machine 10. Copy sheets 16 issue from the printing machine in the direction of arrow A and are deposited onto a stack S in tray 14 with the lead ends of the sheets arrested and aligned against a vertical back stop 18.

Printing machine 10 conventionally includes a pair of ejector wheels 20 in rolling contact with a roller 22 for issuing or discharging sheets 16 from the printing machine toward tray 14. A strand of tinsel material 24 is stretched between a pair of springs 26 and is provided across the sheet path and in contact with the underside of the copy sheets to reduce static electricity in the sheets. An alternate method to reduce static electricity is the electrical type static eliminator.

Sheet receiving tray 14 includes a bottom platform 28 having a downwardly depending flange 30 at each marginal edge (only one flange being shown in FIGS. 1 and 2). Flanges 30 engage within a cut-out 32 of a cabinet portion 34 of the machine. Although not shown in the drawings, appropriate means are provided for mounting and stablizing the receiving tray on the machine.

Receiving tray 14 also includes a pair of side guide walls 36 mounted on platform 28 for acting against the side edges of sheets 16 to align the sheets in a stack in the tray. Side walls 36 also are provided with conventional cut-outs 38 to permit passage of air therethrough to facilitate the stacking of sheets 16 into the tray.

Thus, it can be seen that sheets 16 are delivered seriatim from printing machine 10 into receiving tray 14 whereat the sheets come to rest by gravity onto stack S in the tray. The invention is directed particularly to device 12 for continuously unloading the sheets from the stack at high machine speeds without causing sheet jamming. It is contemplated that the sheet unloading device is readily applicable for other types of duplicating or printing machines or the like, as well as different forms of sheet receiving trays.

Sheet unloading device 12 includes interposer means in the form of L-shaped members, generally designated 40, each having an upstanding leg portion 42 and a generally horizontal leg portion 44. The upstanding leg portions are mounted on a cross bar 46 extending transversely across the end of stack S. Horizontal leg portions 44 define shelf means for interposition into the end of the stack to divide the stack into upper and lower portions in an operative position as shown in FIGS. 1 and 2.

More particularly, referring to FIG. 2, the interposer means, specifically horizontal leg portions 44, divide stack S into a first, lower portion S1 and a second, upper portion S2. As will be described in greater detail, the interposer means permit removal of lower portion S1 of the stack in the direction of arrow B (FIG. 2) while sheets 16 are continuously being delivered to the upper portion S2 of the stack.

Sheet unloading device 12 includes mechanism for mounting the interposer means on tray 14 for movement into and out of its operative position shown in FIGS. 1 and 2. More particularly, referring additionally to FIG. 4, the mounting means includes a frame plate 46 secured by a fastener 48 to depending flange 30 of receiving tray platform 28. Frame plate 46 is stabilized on the flange by an angle bracket 50. A telescoped slide arm, generally designated 52, is pivotally mounted on frame plate 46 by a pivot pin 54 which defines a pivot axis extending transversely of receiving tray 14. Telescoped slide arm 52 includes an inner arm portion 56 and an outer telescoping arm 58 similar to a drawer glide of an office desk or the like. The inner arm portion is pivotable about pin 54 relative to frame plate 46, and the outer arm portion is slidable and extendible relative to the inner arm portion in a direction away from the end of the receiving tray and stack S. Cross bar 46 of the interposer means is secured to the distal end of outer arm portion 58 by a thumb nut 60. The longitudinal position of cross bar 46 at the end of the outer arm portion is slightly adjustable by providing an elongated slot 62 in the outer arm portion through which thumb nut 60 extends.

Thus, the above described mounting mechanism provides for pivoting and sliding movement of the interposer means relative to receiving tray 14 and copy sheet stack S in a swinging path of travel from an inoperative position beneath the tray as shown in phantom in FIG. 4 to the operative position described above in relation to FIGS. 1 and 2.

The interposer means are releasably held in the operative position by an elongated frame plate 47 and the adjacent side wall 36 of tray 14. Frame plate 64 is secured to frame plate 47 by a bolt 66 extending through frame plate 47 and through an elongated slot 68 in frame plate 64. A nut 69 is disposed on the inside of frame plate 64 for threaded engagement with bolt 66. A stabilizing pin 70 is staked within a blind hole on the inside of frame plate 46 and extends through elongated slot 68 in frame plate 64. The stabilizing pin prevents frame plate 64 from pivoting about bolt 66.

Rack means in the form of an upper hook 72 and a lower hook 74 are formed on the outer end edge of frame plate 64 for releasably holding the interposer means in one of two distinct operative positions. Cross bar 46 of the interposer means can be positioned within either hook 72 (FIGS. 1 and 2) or hook 74 in order to perform a sheet removal operation. Of course, additional hooks may be provided to define a plurality of operative positions for the interposer means.

Frame plate 64 also has a third hook 76 for receiving cross bar 46 of the interposer means to define an intermediate position for supporting the interposer means spaced outwardly from the end of the tray and stack S, as shown by full lines in FIG. 4. The intermediate position affords an operator a convenient support for the interposer means when continuously or repeatedly unloading the receiving tray during an extended period. Thus, the interposer means does not have to be swung completely to its inoperative position shown in phantom in FIG. 4.

An important feature of the invention is the ability to move back stop 18 completely away from the end of stack S so that the lower portion S1 of the stack can be removed. More particularly, back stop 18 is slidably mounted in a support block 78 for vertical movement between a first, raised position shown in FIGS. 1 and 4 for arresting sheets deposited into tray 14, and a second, lowered position shown in FIG. 2 to permit removal of the lower portion S1 of the stack of sheets in the tray. A thumb nut 80 holds the back stop in its raised position, and a pair of outwardly protruding lips 82 at the top of the back stop define the lowered position as the lips abut against the top of block 78.

Referring back to FIG. 2, in conjunction with FIG. 3, block 78 is secured by threaded fasteners 84 to a downwardly depending leg 86 of an L-shaped bracket 87 secured to the underside of platform 28 of receiving tray 14. A pad 88 is secured by fasteners 84 to the backside of leg 86, and a spring loaded plunger 90 is disposed in a blind hole of a bolt 92 threaded in a tapped hole provided in pad 88 and leg 86. The plunger holds back stop 18 in position and provides a frictional drag to retain the back stop against inadvertent movement from its raised position. The amount of drag or friction may be adjusted by rotation of threaded bolt 92. To facilitate movement of back stop 18, a knob-like handle 80 is provided for grasping by an operator to selectively move the back stop between its raised position (FIG. 1) and its lowered position (FIG. 2).

Figure 5:
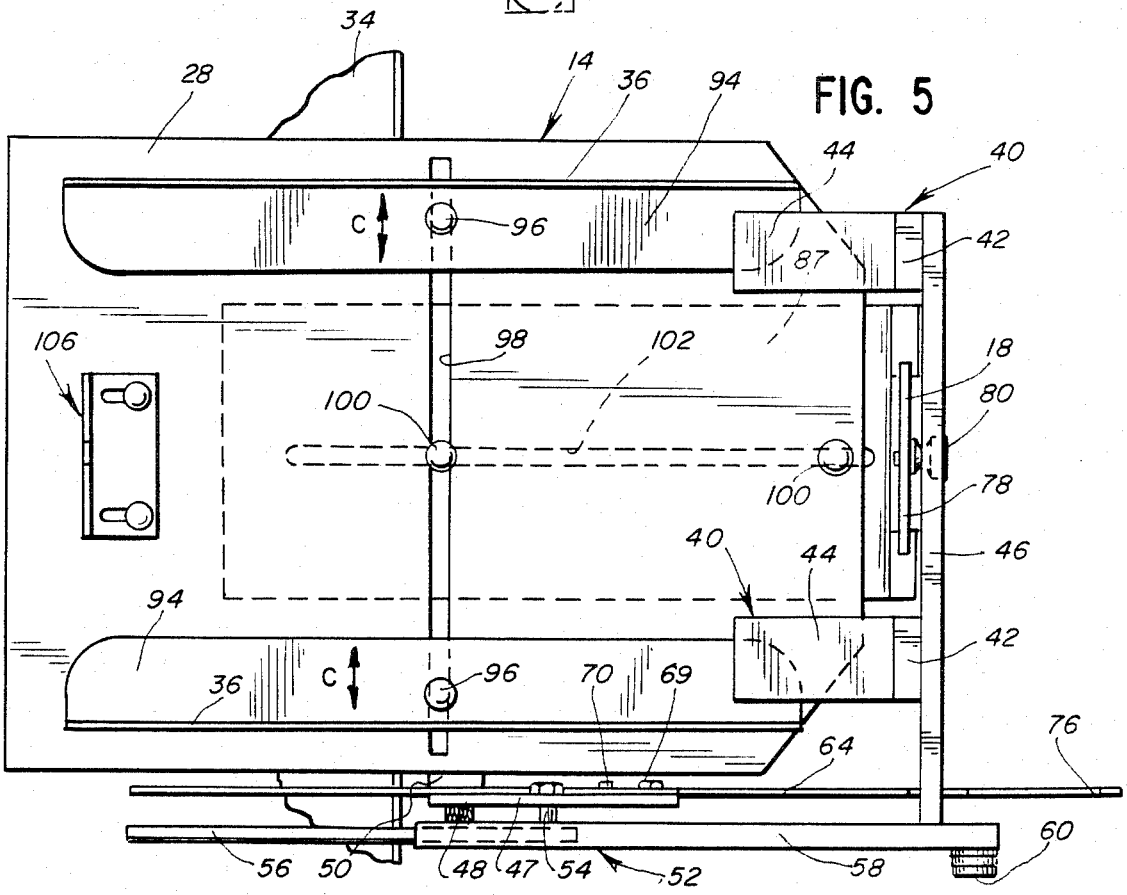
FIG. 5 is a top plan view of the invention in its operative position.

Referring to FIG. 5, lateral adjustment of receiving tray 14 is provided for accurately aligning the sheets in the stack. Each side wall 36 has an inwardly directed flange 94 through which a fastener 96 extends. A transverse slot 98 is provided in platform 28 of the receiving tray. By loosening fasteners 96, side walls 36 can be adjusted laterally in the direction of double-headed arrows C.

In addition, back stop 18 can be adjusted longitudinally of tray 14 by means of fasteners 100 extending through platform 28 of the receiving tray and through a longitudinal slot 102 in bracket 87 which terminates in leg 86 for mounting the back stop. By loosening and tightening fasteners 100, back stop 18 can be moved toward and away from the end of receiving tray 14 to accommodate sheets of different sizes. A conventional, adjustable front stop 106 also is shown at the front of receiving tray 14 in FIG. 5.

In operation of the unloading device of the invention, and assuming that the side walls, the back stop, and side plate 64 all have been adjusted to accommodate a particular sheet size, back stop 18 is secured in its raised position of FIGS. 1 and 4 to arrest sheets 16 issuing from machine 10. The interposer means at this point is disposed either in its inoperative position as shown in phantom in FIG. 4 or in its intermediate position as shown in full lines in that figure. As the sheets issuing from the machine accumulate to form a stack at the bottom of tray 14, the interposer means is moved from its inoperative or its intermediate position to the operative position as shown in FIG. 1. When in that position, sheets issuing from the machine immediately are arrested by the upstanding legs 42 of L-shaped members 40 and come to rest onto the horizontal legs 44 of the L-shaped members. Thus, stack S is divided into lower portion S1 and upper portion S2. Thumb nut 80 then is loosened and back stop 18 is lowered to its position shown in FIG. 2,and the lower portion S1 of the stack can be removed in the direction of arrow B (FIG. 2). Once the lower portion of the stack is removed, back stop 18 is returned to its raised position, the interposer means is returned to either its intermediate or inoperative position, and the upper portion S2 of the stack falls to the bottom of the tray and a new stack S is formed for subsequent and repetitive unloading as described above.

Thus it can be seen that the invention provides a new and improved sheet unloading device to permit continuous unloading of sheets from the receiving tray of a printing or duplicating machine while the machine is operating and without interruptions. The device is simple in construction and operation and does not require an operator to have a high degree of skill in the printing field to effect separation and unloading of the stack from the tray. Continuous unloading of the tray permits duplicating or completing a full sheet feeder load of production without stopping the machine to unload the receiving tray. An operator also can inspect copies and perform other functions without stopping the machine. The invention also permits operation at considerably higher machine speeds with successful continuous unloading of the receiving tray. Furthermore, the device can be readily installed on existing machines with only minor modifications.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A sheet unloading device for use in a printing machine or the like wherein sheets are delivered seriatim to a receiving tray whereat the sheets are deposited onto the top of a stack of sheets in the tray, comprising:

interposer means movable to an operative position at one end of the tray for dividing the stack into a first, lower portion and a second, upper portion to permit removal of the first portion of the stack while sheets are continuously delivered to the second portion of the stack;

means mounting the interposer means for movement from an inoperative positon to the operative position at said end of the tray;

means releasably supporting said interposer means in said operative position; first back stop means mounted at said one end of the tray for generally vertical movement between a raised position to block said end of the tray and a lowered position permitting removal of the first portion of the stack from the tray; and second back stop means on the interposer means and movable therewith into said operative position at said one end of the tray for arresting sheets deposited onto the second portion of the stack when the first back stop means is lowered.

2. The device of claim 1 wherein said mounting means further includes pivot support means for facilitating movement of the interposer means between the operative and inoperative positions.

3. The device of claim 2 wherein said pivot support means includes means defining a pivot axis extending transversely of the tray and means providing for movement of the interposer means generally perpendicular to said pivot axis, thereby providing a swinging path of travel for the interposer means from an inoperative position beneath the tray through an arc around the end of the tray and into the operative position at the end of the tray.

4. The device of claim 3 wherein said rack means includes a plurality of support portions for supporting the interposer means in any one of a plurality of operative positions.

5. The device of claim 4 wherein said rack means further includes a support portion for supporting the interposer means in an intermediate position spaced outwardly from the end of the tray.

6. A sheet unloading device for use in a printing machine or the like wherein sheets are delivered seriatim to a receiving tray whereat the sheets are deposited onto the top of a stack of sheets in the tray, comprising:

interposer means movable to an operative position at the tray for dividing the stack into a first portion and a second portion to permit removal of the first portion of the stack while sheets are continuously delivered to the second portion of the stack;

pivot support means mounting the interposer means for swinging movement in a path of travel from an inoperative position beneath the tray through an arc around the end of the tray and into the operative position at the end of the tray;

rack means releasably supporting said interposer means in said operative position; and first back stop means mounted on the tray for generally vertical movement between a raised position to block the end of the tray and arrest sheets deposited into the tray and a lowered position permitting removal of the first portion of the stack from the tray.

7. The device of claim 6 wherein said pivot support means includes means defining a pivot axis extending transversely of the tray and means providing for sliding movement of the interposer means generally perpendicular to said pivot axis.

8. The device of claim 6 wherein said rack means includes a plurality of support portions for supporting the interposer means in any one of a plurality of operative positions.

9. The device of claim 8 wherein said rack means further includes a support portion for supporting the interposer means in an intermediate position spaced outwardly from the end of the tray.

10. The device of claim 6, including second back stop means on the interposer means for arresting sheets deposited onto the second portion of the stack when the first back stop means is lowered.

11. A sheet unloading device for use in a printing machine or the like wherein sheets are delivered seriatim to a receiving tray whereat the sheets are deposited onto the top of a stack of sheets in the tray, comprising:

interposer means movable to an operative position at the tray for dividing the stack into a first portion and a second portion to permit removal of the first portion of the stack while sheets are continuously delivered to the second portion of the stack; and means for mounting the interposer means adjacent the tray for movement between an inoperative position and said operative position, including rack means mounted on the tray for supporting the interposer means in said operative position, the rack means including a plurality of support portions for supporting the interposer means in any one of a plurality of vertically spaced operative positions.

* * * * *